US006488441B1

(12) United States Patent
Solime'

(10) Patent No.: US 6,488,441 B1
(45) Date of Patent: Dec. 3, 2002

(54) METHOD AND MEANS FOR FORMING ROAD SIGNS

(75) Inventor: Luigi Solime', Cavriago (IT)

(73) Assignee: Impianti 2000 S.N.C. di Valcavi Anna E.C., Cavriago (IT)

( * ) Notice: Subject to any disclaimer, the term of this patent is extended or adjusted under 35 U.S.C. 154(b) by 0 days.

(21) Appl. No.: 09/647,459

(22) PCT Filed: Mar. 22, 1999

(86) PCT No.: PCT/EP99/01976

§ 371 (c)(1),
(2), (4) Date: Sep. 29, 2000

(87) PCT Pub. No.: WO99/50505

PCT Pub. Date: Oct. 7, 1999

(30) Foreign Application Priority Data

Apr. 1, 1998 (IT) ..... RE98A0033

(51) Int. Cl.[7] ..... E01C 5/00

(52) U.S. Cl. ..... 404/42; 404/9; 404/12; 404/13; 40/612

(58) Field of Search ..... 404/14, 16, 12, 404/71, 9, 42, 11, 13; 156/71; 40/612

(56) References Cited

U.S. PATENT DOCUMENTS 1,072,712 A * 9/1913 Fournier
1,534,084 A * 4/1925 Schouboe
1,664,070 A * 3/1928 Foster
1,690,842 A * 11/1928 Sanna
1,732,869 A * 10/1929 Wambach
1,885,720 A * 11/1932 Hewett
1,886,720 A * 11/1932 O'Brien
2,142,946 A * 1/1939 Hunter
3,512,460 A * 5/1970 Surine et al.
5,249,884 A 10/1993 Widmer
5,667,335 A * 9/1997 Khieu et al.
5,857,801 A * 1/1999 Brown

FOREIGN PATENT DOCUMENTS

| | | | |
|---|---|---|---|
| CH | 669626 | A | 3/1989 |
| DE | 8902853 | U | 7/1989 |
| DE | 4244210 | A | 7/1994 |
| DE | 9420050 | U | 3/1995 |
| WO | WO9631656 | A | 10/1996 |

* cited by examiner

*Primary Examiner*—Heather Shackelford
*Assistant Examiner*—Katherine Mitchell
(74) *Attorney, Agent, or Firm*—Birch, Stewart, Kolasch & Birch, LLP

(57) ABSTRACT

According to the invention, blocks (10) are formed of rigid colored material shaped as mosaic components of the road sign; the sign is then composed by arranging the blocks (10) as a mosaic, and incorporatedly inserting the blocks (10) into the upper layer (40) of the wearing course, in such a manner that the upper surface of the mosaic road sign is substantially coplanar with the road surface.

8 Claims, 2 Drawing Sheets

METHOD AND MEANS FOR FORMING ROAD SIGNS

This application is the national phase under 35 U.S.C. §371 of PCT International Application No. PCT/EP99/01976 which has an International filing date of Mar. 22, 1999, which designated the United States of America.

BACKGROUND AND SUMMARY OF THE INVENTION

1. Technical Field

The present invention relates to a method for manufacturing road signs, in roads in which the wearing course comprises an upper layer of asphalt or similar material. The present invention is also directed to the structural nature of the road signs.

2. Disclosure of the Invention

The method of the invention comprises: forming blocks of rigid colored material shaped as mosaic components of the road sign; arranging the blocks as a mosaic; and inserting the blocks into the upper layer of the wearing course in such a manner that the upper surface of the mosaic road sign is substantially coplanar with the road surface.

The component blocks can be formed of material relatively resistant to the wear which occurs on the road surface by normal vehicle and people passage. In addition these blocks can be of many millimeters thickness and can be colored throughout.

Consequently by virtue of the invention, a road sign incorporated into the wearing course is formed, which can have a very long life under normal use of the road.

Moreover, the road sign formed can have a relatively high vivacity and brightness, and in any event greater than those of the usual road signs formed by being painted on the road surface.

BRIEF DESCRIPTION OF THE DRAWINGS

The present invention is described in detail hereinafter with the air of the accompanying drawings, which illustrate a non-limitative embodiment thereof, wherein.

DETAILED DESCRIPTION OF THE INVENTION

According to the present invention, blocks 10 of rigid colored material are formed and shaped to enable the required road sign to be formed in a mosaic technique.

Figure 1:
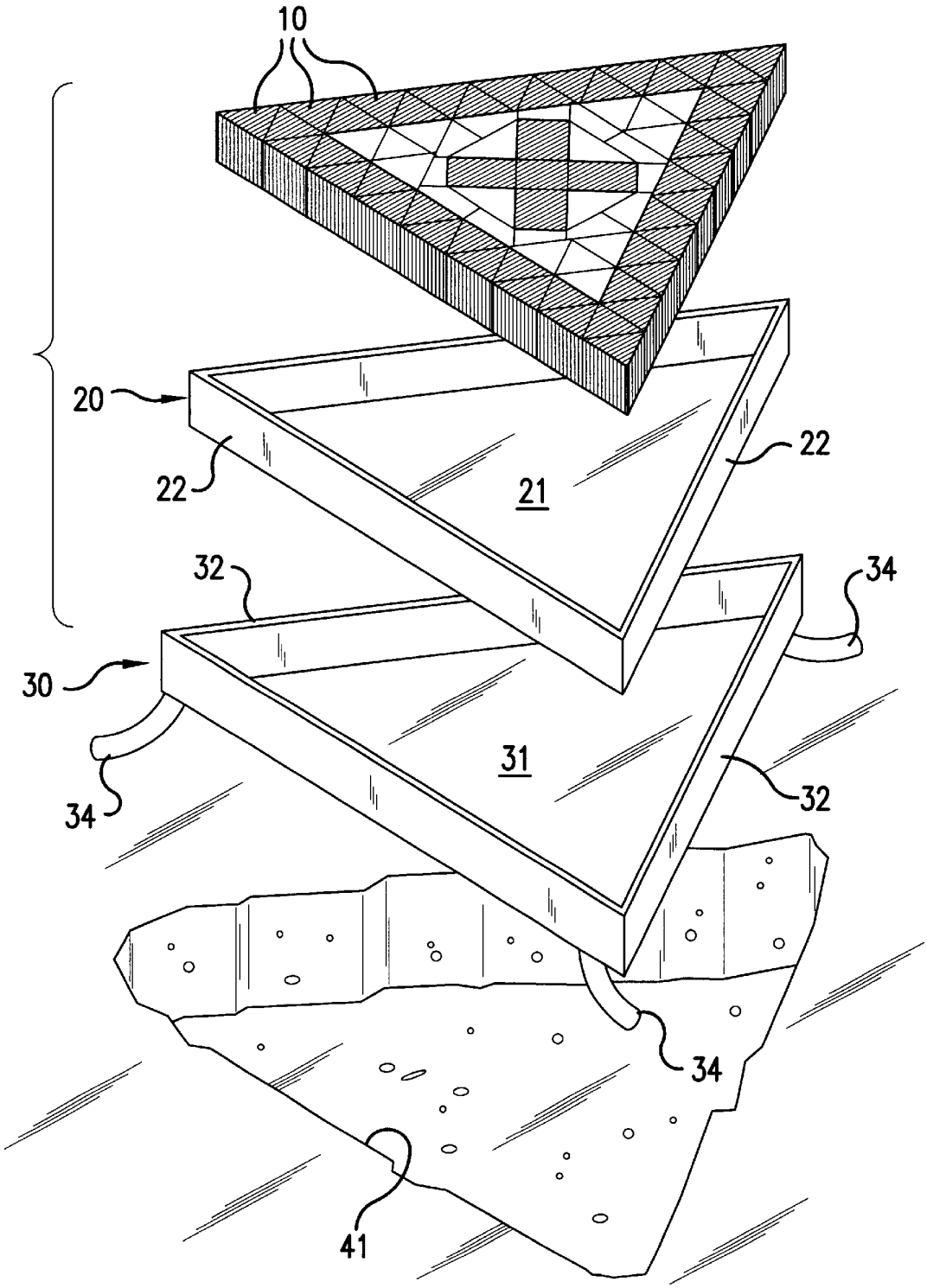
FIG. 1 is a perspective exploded view of the structural components of the invention.
Figure 2:
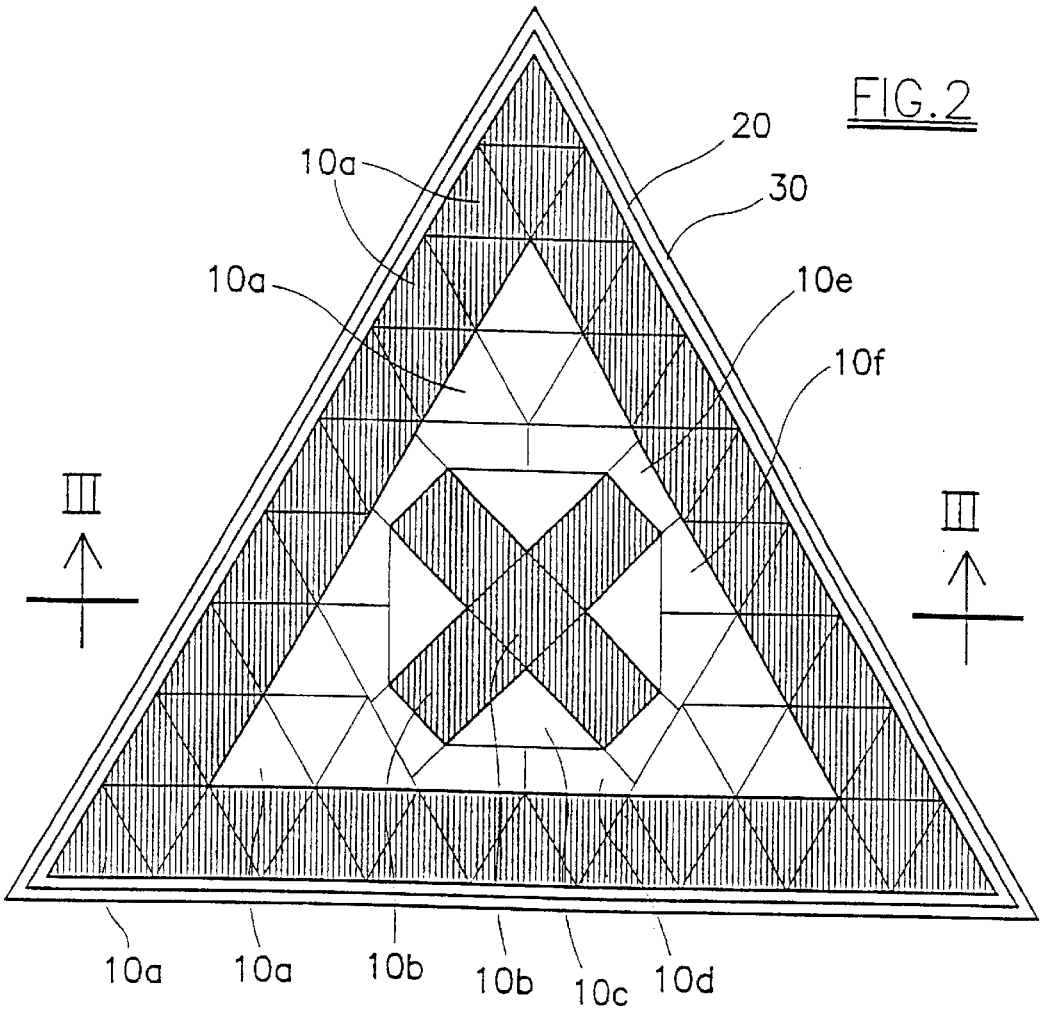
FIG. 2 is a top plan view of the road sign.

The blocks 10 are of prismatic shape and are all of equal height. The geometric shape of their base determines the figure which is to be composed. This shape can be constant, or as shown in the drawings, can vary from block to block, even within the same figure of the road sign to be formed. The blocks can be fitted together without creating noticeable gaps between one and another. FIG. 2 shows an example of a road sign indicating a "dangerous crossing".

The figure of this road sign is obtained by a plurality of blocks 10, the base of which varies in shape and dimensions. For example, various blocks 10*a* have a base which have the form of an equilateral triangle (these forming the peripheral part of the figure). Some blocks 10*b* have a square base (these forming "X"). Some blocks 10*a* have a base which has the form of an isosceles triangle (positioned about the "X"). Other blocks 10*d,* 10*e* and 10*f,* have different shapes which surround the central figure.

Obviously this is only one example, it being apparent that the number of road sign figures which can be obtained is indeterminate and consequently the shapes and dimensions of the bases of the blocks 10 can vary. In addition the color of the blocks varies in forming a road sign composed of a number of colors. For example, in FIG. 2 some blocks 10*a* are of one color, whereas other blocks 10*a* are of another color.

Advantageously, the blocks 10 are formed of fired ceramic, in particular by using the method used to form porcellainized ceramic stone tiles.

In particular, the blocks 10 are of ceramic material colored throughout. In the embodiment shown in the figures, a pan-like container 20 is provided having a prismatic shape with a relatively large base 21 and relatively low vertical side walls 22, but without a lid. The container 20 is arranged to contain, substantially as an exact fit, the road sign composed in mosaic form by the blocks 10, In particular, its base 21 is substantially equal to the shape of the entire road sign, except for a slight clearance, and its side walls have a height virtually equal to the height of the blocks 10.

Figure 3:
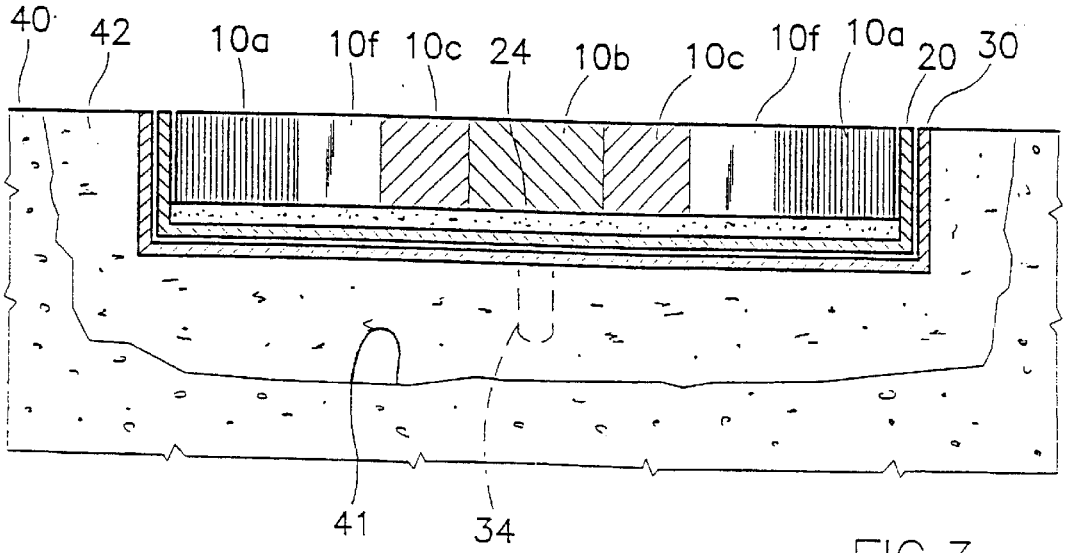
FIG. 3 is a sectional view taken along line III—III of FIG. 2.

In addition, again in the embodiment shown in the figures, a second pan-like container 30 is provided to contain the first pan-like container 20 substantially as an exact fit (with a slight clearance) and to be immersed into the upper layer of the wearing course (FIG. 3). In particular, the second container 30 has a base 31 of the same shape as but slightly wider than the base 21. Its vertical side walls 32 have a height virtually equal to the walls 22 of the first container 20.

An embodiment of the method of the present invention, the second container 30 is inserted into the upper layer of the wearing course, so that the container cavity remains empty and faces upwards.

Typically, the container 30 can be inserted into a cavity 41 formed in the upper layer 40 (of asphalt or equivalent material) of the wearing course. The cavity 41 has a width slightly greater than the outer dimension of the second container 30. After the container 30 has been inserted into the cavity 41, a filling material 42 (adhesive-based or the same asphalt forming the layer 40) is applied to close the cavity about the container 30 so that the container remains embedded in the layer 40 with its upper edge substantially coplanar with the road surface.

Preferably the container 30 possesses suitable lugs 34 to enable it to better grip the material in which it is embedded.

The blocks 10 are first inserted into the first container 20, said blocks being composed as a mosaic to form the road sing. They can be inserted dry, or can be glued to the base 21 by an adhesive layer 24 (see FIG. 3). They can also be glued together by adhesive inserted between adjacent blocks. This insertion of the blocks 10 into the containers 20 can obviously be advantageously done in an appropriate factory equipped for this purpose. The container 20 containing the mosaic road sign is then taken to its place of application and is inserted into the second container 30, taking care that the upper surface of the mosaic road sign is substantially coplanar with the road surface.

In this manner a road sign is inserted into the wearing course, as a component of the wearing course itself.

Moreover this road sign is formed of a material which is highly resistant to wear and hence long-lasting.

Furthermore, given that the blocks are colored throughout, the configuration formed by them lasts until the entire thickness of the blocks has been worn away since this thickness can be some centimeters in practice, the resistance to abrasive wear of the road sign formed in this manner is practically infinite.

Again, as the road sign is composed of several blocks 10 associated with each other but slightly movable relative to each other, the road sign is at least slightly deformable under the stress of passing vehicles, and hence advantageously, in response to this stress, has the same behavior as the wearing course.

The container 30 remains permanently incorporated into the wearing course, and serves essentially as the base for the first container 20. This can be extracted from the container 30, together with the road sign, for repair or replacement.

Alternatively, the second container 30 can be dispensed with. In this case, the container 20 together with the mosaic of blocks 10 is embedded directly into the upper layer of the wearing course, such that the upper surface of the road sign is substantially coplanar with the road surface.

As a further alternative the first container 20 can be dispensed with. In this case the blocks 10 are embedded directly into the upper surface of the wearing course, again such that upper surface of the mosaic road sign is substantially coplanar with the road surface.

Numerous modifications of a practical and applicational nature can be made to the present invention, but without departing from the breadth and scope thereof.

What is claimed is:

1. A method for constructing road signs in the wearing surface of a road which comprises, forming blocks of a rigid colored ceramic material, which are colored throughout;

arranging the blocks as mosaic components of the road sign within a pan-like container adapted to receive the thus composed road sign substantially as an exact fit; then inserting the road sign disposed in said pan-like container into a cavity formed in the upper layer of the wearing course, and inserting the blocks into a cavity formed in an upper layer of the wearing course in such a manner that the mosaic components of the road sign are incorporated into said cavity such that the upper surface of the mosaic road sign is substantially coplanar with the road surface.

2. A road sign adapted to be formed in the wearing surface of a road and substantially coplanar therewith which comprises:

a plurality of blocks shaped in such a manner as to form the desired road sign using a mosaic technique, wherein the plurality of blocks are disposed in a first pan-like container arranged to contain, substantially as an exact fit, the road sign composed as the mosaic of blocks.

3. That the road sign of claim 2, wherein said blocks are porcellaninized stone.

4. The road signs of claim 2, wherein the first pan-like container is disposed in a second pan-like container to form a composite structure which, in turn is adapted to be immersed in an upper layer of the wearing course.

5. The road signs of claim 4, wherein an anchoring element extends from the second pan-like container.

6. The road sign of claim 2, wherein said blocks are formed of ceramic materials which are colored throughout.

7. The road sign of claim 2, wherein the wearing surface is asphalt or similar material.

8. A method for constructing road signs in the wearing surface of a road which comprises:

forming blocks of a rigid colored ceramic material, which are colored throughout;

arranging the blocks as mosaic components of the road sign, within a first pan-like container adapted to receive the thus composed road sign substantially as an exact fit;

inserting a second pan-like container, adapted to contain the first pan-like container substantially as an exact fit, into the upper layer of the wearing course; and inserting the first pan-like container containing the mosaic road sign into the second pan-like container.

* * * * *